US010966521B2

(12) United States Patent
Chen

(10) Patent No.: US 10,966,521 B2
(45) Date of Patent: Apr. 6, 2021

(54) SELF-LOCKING SLIDE RAIL DEVICE WITH BUFFER MECHANISM

(71) Applicant: MARTAS PRECISION SLIDE CO., LTD., New Taipei (TW)

(72) Inventor: Wan-Lai Chen, New Taipei (TW)

(73) Assignee: MARTAS PRECISION SLIDE CO., LTD., New Taipei (TW)

( * ) Notice: Subject to any disclaimer, the term of this patent is extended or adjusted under 35 U.S.C. 154(b) by 0 days.

(21) Appl. No.: 16/694,882

(22) Filed: Nov. 25, 2019

(65) Prior Publication Data

US 2021/0052073 A1 Feb. 25, 2021

(30) Foreign Application Priority Data

Aug. 20, 2019 (TW) ..... 108129571

(51) Int. Cl.
*A47B 88/49* (2017.01)
*A47B 88/50* (2017.01)

(52) U.S. Cl.
CPC ..... *A47B 88/49* (2017.01); *A47B 88/50* (2017.01)

(58) Field of Classification Search
CPC ..... A47B 88/467; A47B 88/40; A47B 88/473; A47B 88/423; A47B 88/49; A47B 88/50; E05F 5/027
See application file for complete search history.

(56) References Cited

U.S. PATENT DOCUMENTS 6,220,683 B1 * 4/2001 Chu ..... A47B 88/49 312/334.44
6,799,817 B1 * 10/2004 Chu ..... A47B 88/49 312/330.1
7,077,487 B2 * 7/2006 Yang ..... A47B 88/467 312/319.1
7,244,005 B1 * 7/2007 Lu ..... A47B 88/467 312/319.1
7,784,890 B1 * 8/2010 Chen ..... F16F 9/0209 312/319.1
8,052,232 B1 * 11/2011 Chen ..... F16F 9/0209 312/319.1
8,132,873 B2 * 3/2012 Yang ..... A47B 88/467 312/333
8,511,764 B1 * 8/2013 Chen ..... A47B 88/467 312/333
8,939,525 B1 * 1/2015 Chen ..... A47B 88/467 312/333
9,648,952 B2 * 5/2017 Nuckolls ..... A47B 88/463
2005/0093406 A1 * 5/2005 Yang ..... A47B 88/467 312/333
2006/0091771 A1 * 5/2006 Teskey ..... A47B 88/49 312/334.44

(Continued)

*Primary Examiner* — Hanh V Tran
(74) *Attorney, Agent, or Firm* — Li & Cai Intellectual Property (USA) Office

(57) ABSTRACT

A self-locking slide rail device with buffer mechanism includes a slide rail, a fixing seat, a sliding seat, a hook member, two springs, a connecting member, and a buffer. The slide rail includes an outer rail and an inner rail. The fixing seat is disposed on a rear end of the outer rail, and has a body portion and a guiding extension portion. The sliding seat is disposed on the guiding extension portion. The hook member is disposed on the sliding seat. The two springs are disposed in parallel with each other on the fixing seat. The connecting member is disposed on the inner rail to interlink with the hook member. The buffer is disposed on the center of the body portion.

5 Claims, 11 Drawing Sheets

(56) References Cited

U.S. PATENT DOCUMENTS

2008/0061663 A1* 3/2008 Wu ..... A47B 88/467 312/333
2008/0100190 A1* 5/2008 Yang ..... A47B 88/40 312/333
2008/0303399 A1* 12/2008 Huang ..... A47B 88/49 312/334.46
2009/0021129 A1* 1/2009 Hu ..... A47B 88/467 312/333
2009/0091225 A1* 4/2009 Yang ..... A47B 88/467 312/334.1
2009/0115300 A1* 5/2009 Chen ..... A47B 88/467 312/334.1
2009/0121595 A1* 5/2009 Yang ..... A47B 88/467 312/334.1
2009/0140621 A1* 6/2009 Yang ..... A47B 88/467 312/319.1
2009/0189499 A1* 7/2009 Yang ..... A47B 88/467 312/334.44
2010/0026152 A1* 2/2010 Huang ..... A47B 88/463 312/319.1
2010/0164340 A1* 7/2010 Juan ..... A47B 88/467 312/333
2010/0176700 A1* 7/2010 Perez ..... A47B 88/467 312/334.8
2011/0043087 A1* 2/2011 Shih ..... A47B 88/467 312/334.1
2011/0175508 A1* 7/2011 Rechberg ..... A47B 88/467 312/334.8
2011/0176755 A1* 7/2011 Chen ..... A47B 88/45 384/21
2012/0144622 A1* 6/2012 Juan ..... A47B 88/467 16/51
2013/0028544 A1* 1/2013 Lowe ..... A47B 88/467 384/21
2014/0079347 A1* 3/2014 Huang ..... A47B 88/467 384/21
2015/0131929 A1* 5/2015 Park ..... A47B 88/467 384/21
2017/0086583 A1* 3/2017 Chen ..... A47B 88/463
2018/0132615 A1* 5/2018 Kim ..... A47B 88/467
2018/0306236 A1* 10/2018 Liu ..... A47B 88/49
2019/0069672 A1* 3/2019 Pan ..... E05F 1/16

* cited by examiner

SELF-LOCKING SLIDE RAIL DEVICE WITH BUFFER MECHANISM

CROSS-REFERENCE TO RELATED PATENT APPLICATION

This application claims the benefit of priority to Taiwan Patent Application No. 108129571, filed on Aug. 20, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a self-locking slide rail device with buffer mechanism, and more particularly to a self-locking slide rail device with buffer mechanism for ball slides or drawer slides.

BACKGROUND OF THE DISCLOSURE

A conventional self-locking slide rail device with buffer mechanism usually includes many moving parts, which results in complicated and easy-to-malfunction structure of the self-locking mechanism with buffer mechanism.

Moreover, due to the vibration of the inner or the outer rail being shaken, the meshing positions of the components in the self-locking slide rail device with buffer mechanism may suffer from displacement, so that the mechanism cannot perform its intended function.

SUMMARY OF THE DISCLOSURE

In response to the above-referenced technical inadequacies, the present disclosure provides a self-locking slide rail device with buffer mechanism.

In one aspect, the present disclosure provides a self-locking slide rail device with buffer mechanism including a slide rail, a fixing seat, a sliding seat, a hook member, two springs, a connecting member, and a buffer. The slide rail includes an outer rail and an inner rail, in which the outer rail defines a longitudinal axis direction and a horizontal axis direction. Two ends of the slide rail along the longitudinal axis direction are respectively defined as a front end and a rear end. The slide rail has a bottom plate of the outer rail, and sidewalls of the outer rail located on two sides of the bottom plate of the outer rail along the horizontal axis direction. The inner rail is disposed on the outer rail, and the inner rail is capable of reciprocally moving along the longitudinal axis direction between an open position near the front end of the outer rail and a closed position near the rear end of the outer rail. The fixing seat is disposed on the rear end of the outer rail, in which the fixing seat has a body portion and a guiding extension portion. The guiding extension portion is connected to the front end of the body portion and extends towards a direction of the front end of the slide rail. The fixing seat has a positioning slot formed at the position near the front end position of the guiding extension portion. The sliding seat is slidably disposed on the guiding extension portion and is capable of reciprocally moving between a first position adjacent to the front end of the guiding extension portion and a second position adjacent to the rear end of the guiding extension portion. The hook member is swingably disposed on the sliding seat, in which when the sliding seat moves to the first position, the hook member is capable of being engaged in the positioning slot so as to fixedly position the sliding seat at the first position. The two springs are disposed in parallel with each other on the fixing seat and two sides of the sliding seat along the horizontal axis direction, in which two ends of each of the two springs are respectively connected to the fixing seat and the sliding seat. The connecting member is disposed on a side of a bottom plate of the inner rail facing towards the outer rail. When the inner rail moves to the closed position, the connecting member is capable of driving the hook member to swing and disengage from the positioning slot, such that the hook is coupled to the connecting member. The inner rail and the sliding seat are capable of interlinking with each other by the hook member and the connecting member so as to be capable of synchronous movement. The buffer is disposed on the center of the body portion, and the buffer includes a buffer cylinder and a telescopic rod telescopically disposed within the buffer cylinder. A front end of the telescopic rod is connected to the rear end of the sliding seat and is capable of stretching along the longitudinal axis direction. The sliding seat is capable of shortening the telescopic rod when the sliding seat moves toward the second position. The fixing seat has a first positioning engagement portion that is disposed on the guiding extension portion and protrudes toward the front end direction of the slide rail. The fixing seat further has a second positioning engagement portion disposed between the first positioning engagement portion and the body portion. The slide rail further includes a first positioning hook and a second positioning hook respectively disposed on the positions where the bottom plate of the outer rail corresponds to the first positioning engagement portion and the second positioning engagement portion. The first positioning hook engages with the first positioning engagement portion, and the second positioning hook engages with the second positioning engagement portion. Two side positioning members are respectively disposed on two sides of the body portion of the fixing seat along the horizontal axis direction. When the inner rail moves to the closed position, the rear end of the inner rail is accommodated between the two side positioning members.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
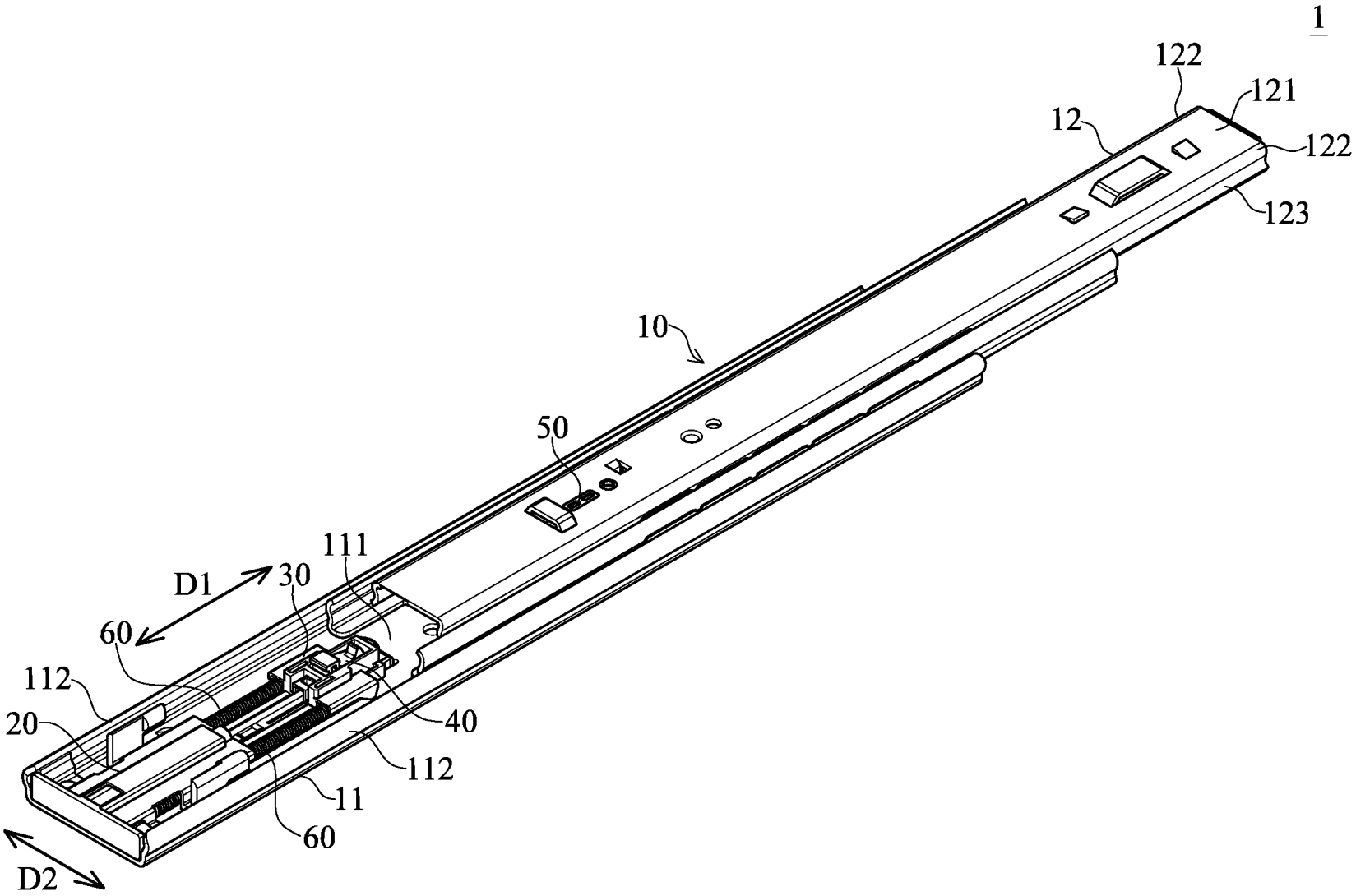
FIG. 1 is an assembled perspective view of a self-locking slide rail device with a buffer mechanism according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 11, a first embodiment of the present disclosure provides a self-locking slide rail device with a buffer mechanism is illustrated. The self-locking slide rail device includes a slide rail 10, a fixing seat 20, a sliding seat 30, a hook member 40, a connecting member 50, two springs 60, and a buffer 70.

Figure 2:
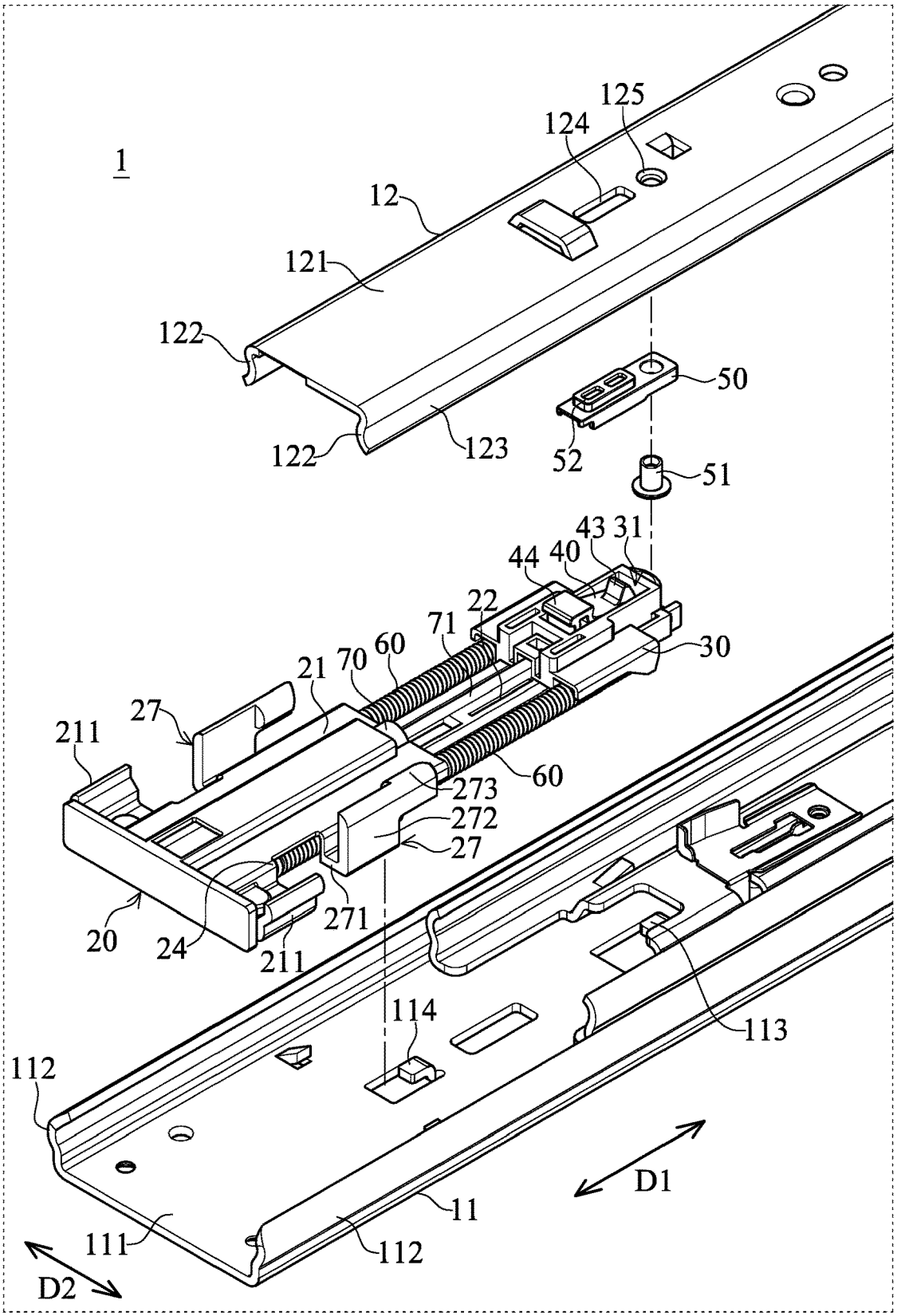
FIG. 2 is an exploded partial view of the self-locking slide rail device with buffer mechanism according to the first embodiment of the present disclosure.

As shown in FIG. 1 and FIG. 2, the slide rail 10 includes an outer rail 11 and an inner rail 12 disposed on the outer rail 11. For ease of illustration, the direction parallel to the central axis of the slide rail 10 is defined as a longitudinal axis direction D1. The width direction of the slide rail 10 is defined as a horizontal axis direction D2, and two ends of the slide rail 10 along the longitudinal axis direction D1 are respectively defined as a front end and a rear end.

In the present embodiment, the outer rail 11 has a bottom plate of the outer rail 111, and sidewalls of the outer rail 112 located on two ends of the outer rail 11 along the horizontal axis direction D2. The inner rail 12 is accommodated between the two sidewalls of the outer rail 112. The inner rail 12 has a bottom plate of the inner rail 121, and two sidewalls of the inner rail 122 located on two ends of the inner rail 121 along the horizontal axis direction D2. The inner rail 12 has two grooves 123 respectively disposed on the two sidewalls of the inner rail 122. In the present embodiment, the inner rail 12 can reciprocally move between an open position extending from the outside of the front end of the outer rail 11 and a closed position near the rear end of the outer rail 11 by installing balls inside of the outer rail 11.

The fixing seat 20 disposed on the rear end of the outer rail 11 has a body portion 21 and a guiding extension portion 22 connected to a front end of the body portion 21. The body portion 21 is disposed in an accommodating space defined by the bottom plate of the outer rail 111 and the two sidewalls of the outer rail 112. Two sides of the body portion 21 along the horizontal axis direction D2 each have a top support portion 211. When the body portion 21 is inserted into the rear end of the outer rail 11, outer sidewalls of the two top support portions 211 can couple with inner sides of the two sidewalls of the outer rail 112 by interference such that the fixing seat 20 can be fixed on the rear end of the outer rail 11.

When the fixing seat 20 is assembled to the rear end of the outer rail 11, the guiding extension portion 22 abuts against a side of the bottom plate of the outer rail 111 facing towards the inner rail 12, and the guiding extension portion 22 extends toward the front end of the slide rail 10. Two sides of the guiding extension portion 22 each form a guiding flange 233 along the horizontal axis direction D2. A positioning slot 23 is formed near the front end position of the guiding extension portion 22, and a first positioning engagement portion 25 is formed on the position in front of the positioning slot 23. A second positioning engagement portion 26 is formed between the first positioning engagement portion 25 and the front side of the body portion 21. A notch 261 is formed on the front position adjacent to the second positioning engagement portion 26.

Figure 6:
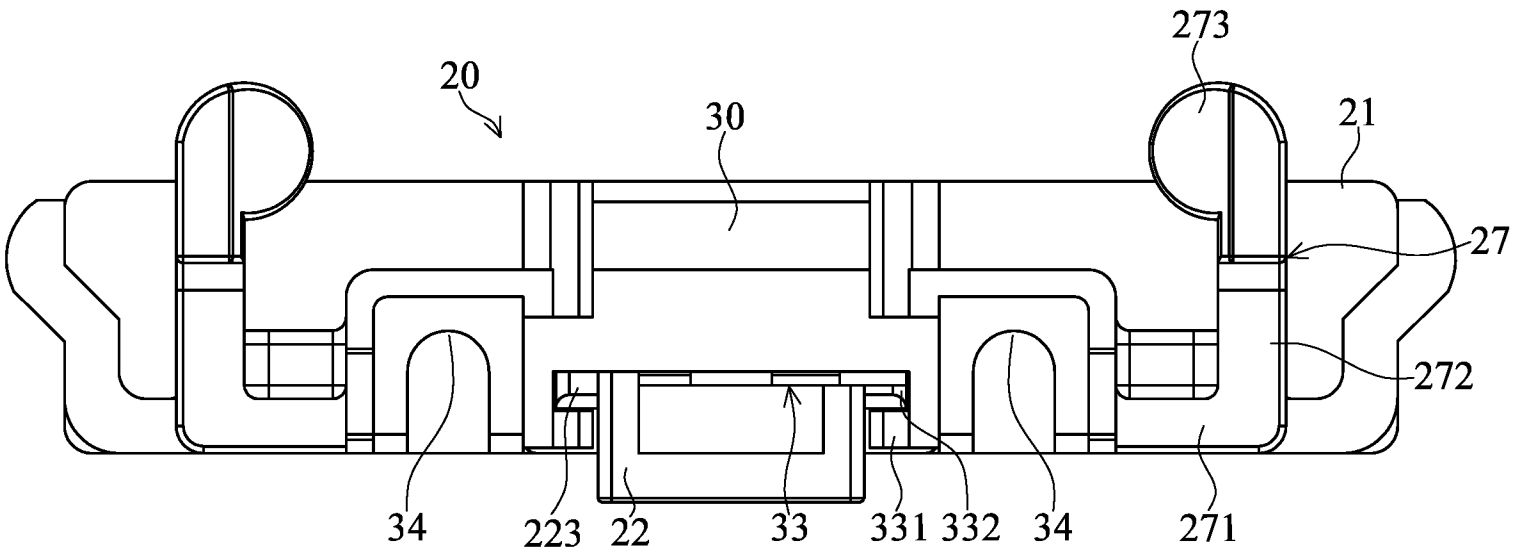
FIG. 6 is a planar view showing a state in which the fixing seat and the sliding seat are coupled with each other according to the first embodiment of the present disclosure.
Figure 7:
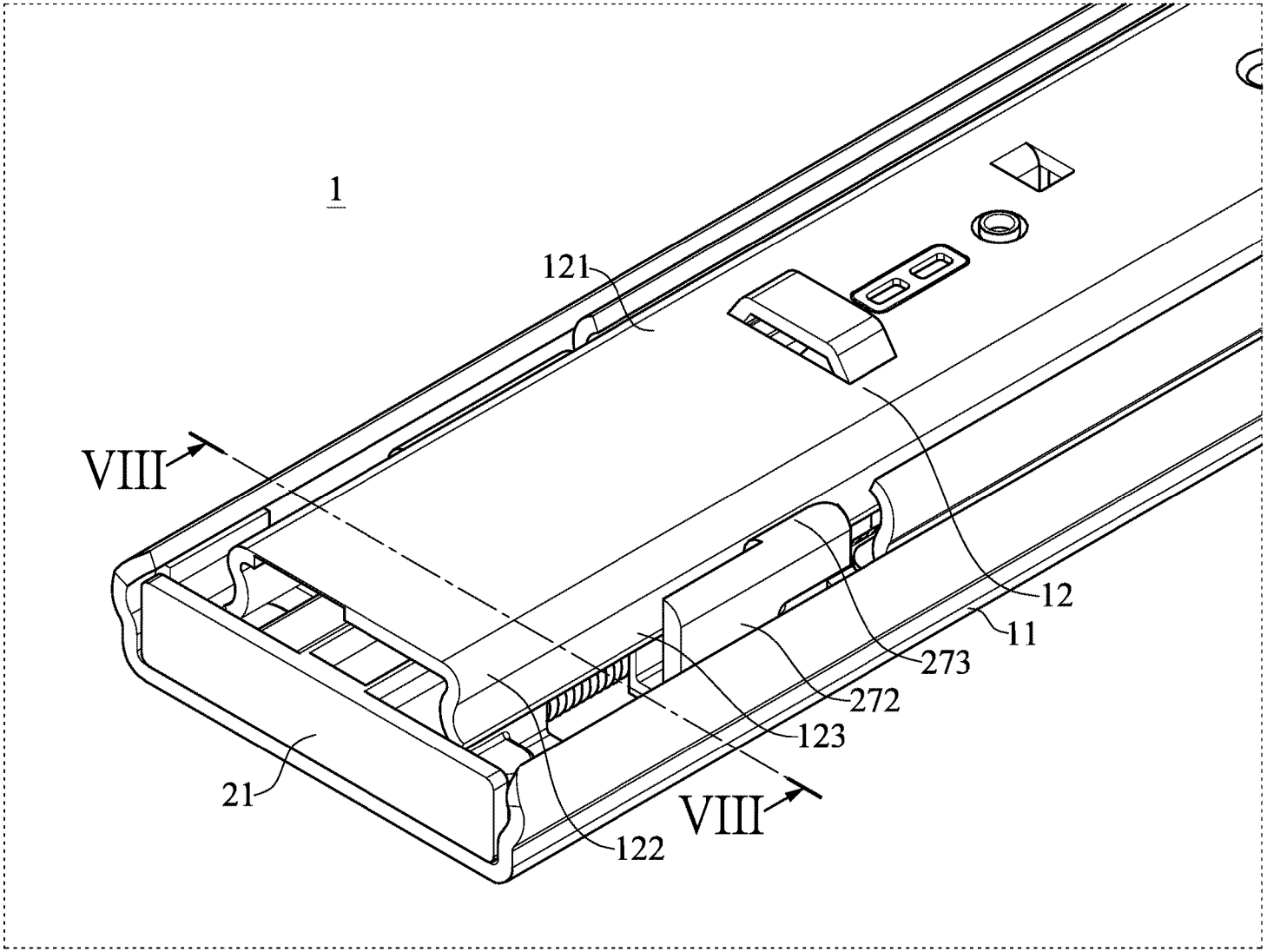
FIG. 7 is a perspective view showing a state in which the inner rail is closed according to the first embodiment of the present disclosure.
Figure 8:
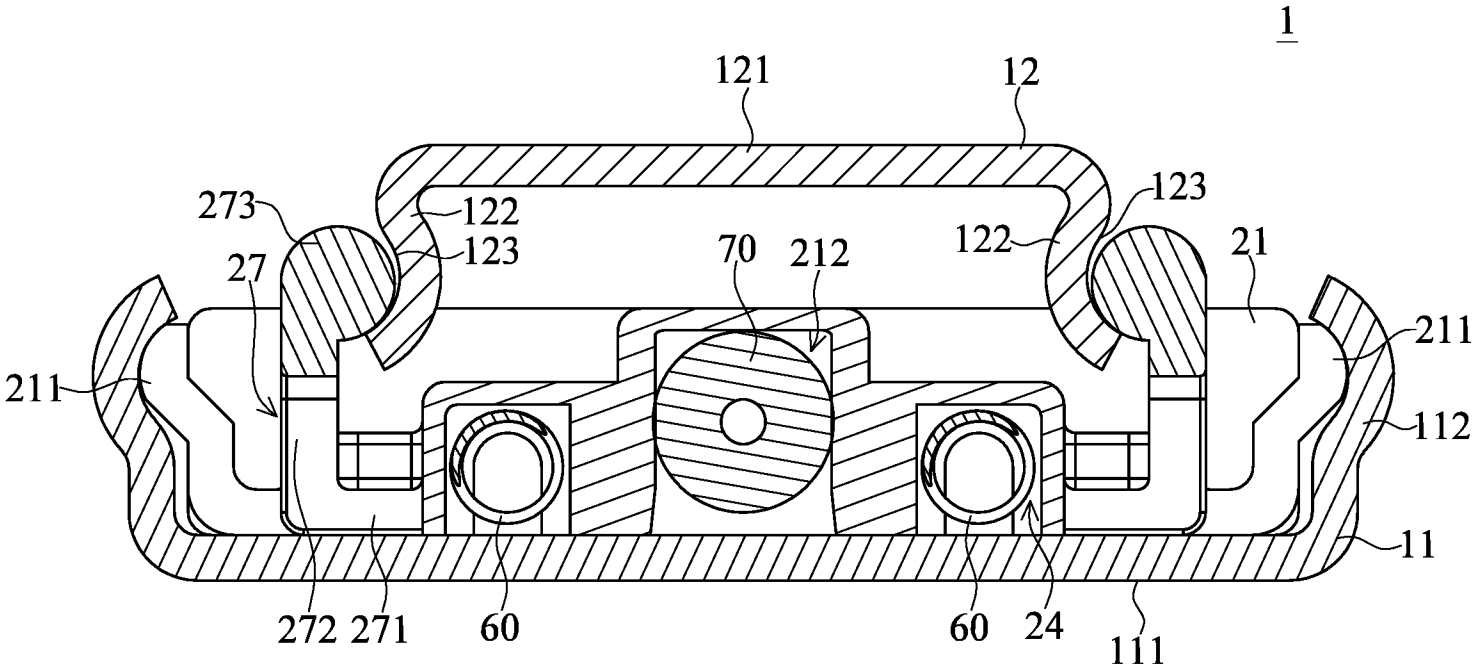
FIG. 8 is a cross-sectional view taken along line VIII-VIII of FIG. 7.
Figure 9:
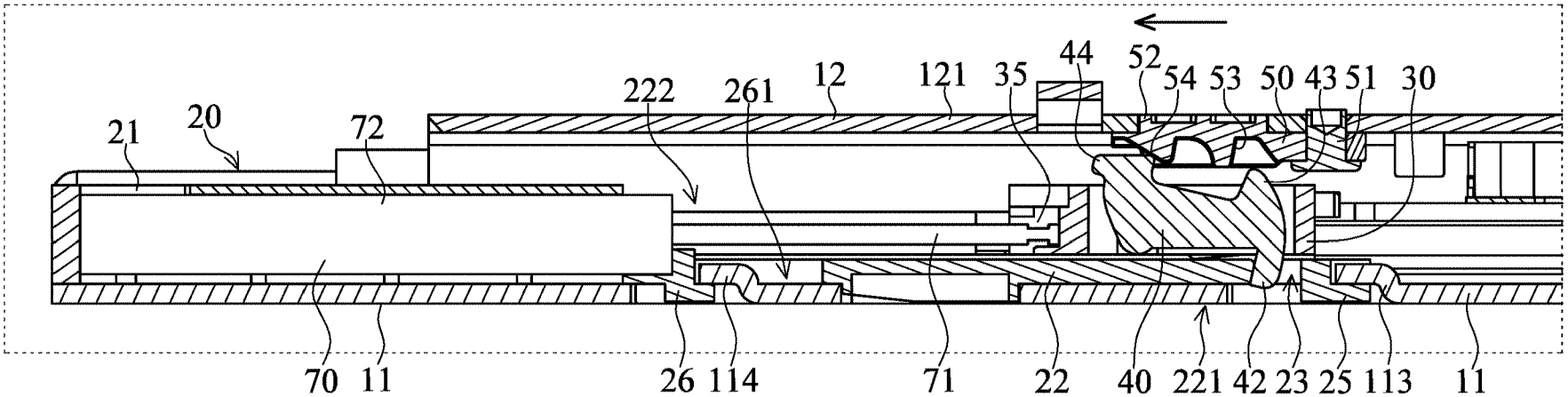
FIG. 9 and FIG. 10 are schematic views showing the interlinking manner of the connecting member and the hook member when the slide rail is closed.

As shown in FIG. 2, FIG. 6, and FIG. 0.9, in the present embodiment, the cross-sectional shape of the first positioning engagement portion 25 and the second positioning engagement portion 26 along the longitudinal axis direction D1 are substantially rectangular, and protrude toward the front of the slide rail 10. A first positioning hook 113 is disposed on the bottom plate of the outer rail 111 opposite to the first positioning engagement portion 25. A second positioning hook 114 is disposed on the bottom plate of the outer rail 111 opposite to the second positioning engagement portion 26. In the present embodiment, the first positioning engagement portion 25 and the second positioning engagement portion 26 each has a vertical portion connected to the bottom plate of the outer rail 111 and a horizontal portion connected to the end of the vertical portion. The horizontal portion of the first positioning engagement portion 25 and the second positioning engagement portion 26 extend toward the rear end of the slide rail 10. The height of the space between the bottom plate of the outer rail 111 and the bottom sides of the horizontal portion of the first positioning engagement portion 25 and the second positioning engagement portion 26 substantially matches with the thickness of the first positioning engagement portion 25 and the second positioning engagement portion 26, such that the first positioning engagement portion 25 and the second positioning engagement portion 26 can be inserted into the spaces between the first positioning hook 113, the second positioning hook 114, and the bottom plate of the outer rail 111. As shown in FIG. 9, when the fixing seat 20 is disposed on the rear end of the slide rail 10, the first positioning hook 113 and the second positioning hook 114 respectively hook onto the first positioning engagement portion 25 and the second positioning engagement portion 26 such that the guiding extension portion 22 is fixed on the bottom plate of the outer rail 111.

As shown in FIG. 2 to FIG. 5, the sliding seat 30 disposed on the guiding extension portion 22 of the fixing seat 20 is slidable along longitudinal axis direction D1. A receiving portion 31 penetrating from the top surface to the bottom surface is formed on the center of the sliding seat 30 to accommodate the hook member 40. A pivot slot 32 is formed at the two sidewalls of the receiving portion 31 along the horizontal axis direction to engage a rotating shaft 41 of the two sides of the hook member 40 therein such that the hook member 40 can be disposed on the sliding seat 30 pivotally.

Figure 4:
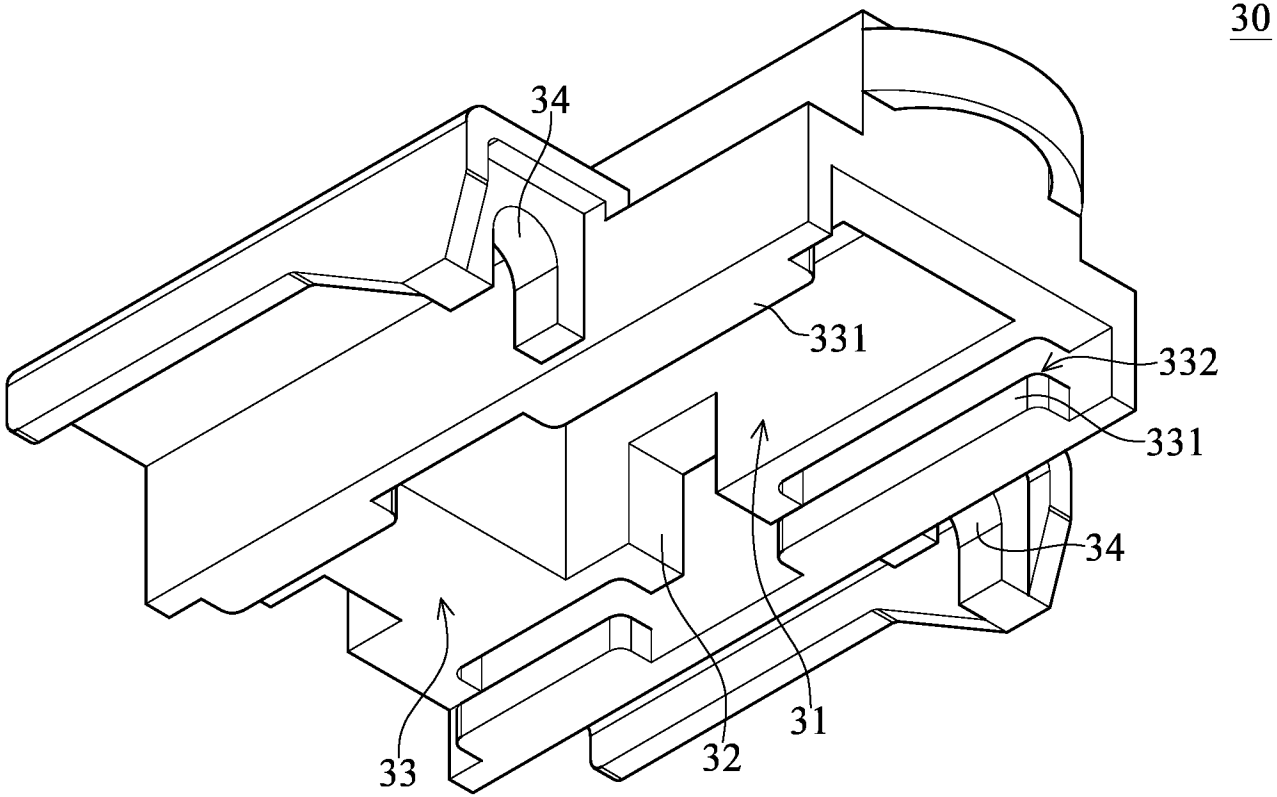
FIG. 4 is a perspective view taken from the bottom surface of the sliding seat according to the first embodiment of the present disclosure.
Figure 5:
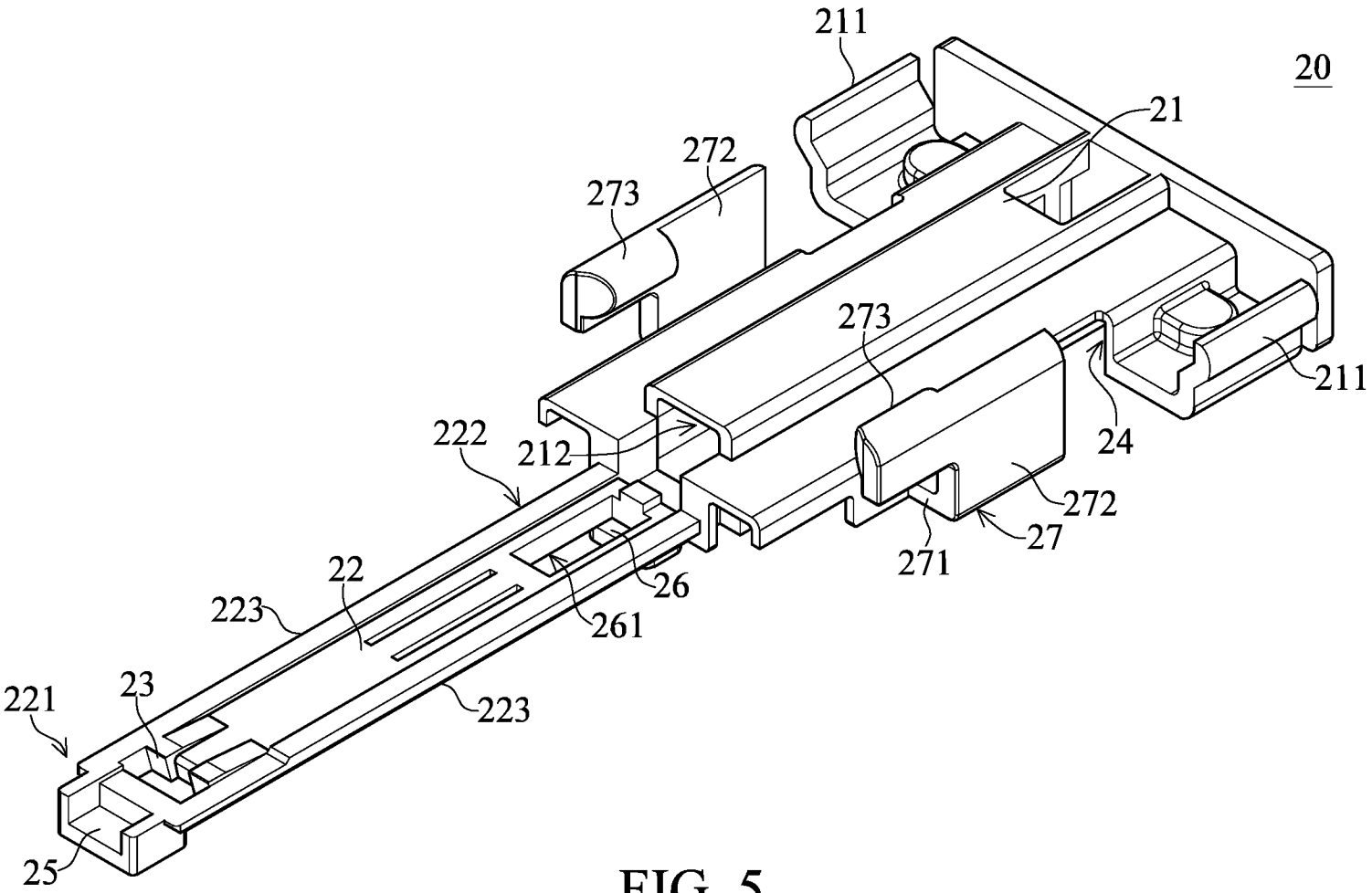
FIG. 5 is a perspective view of a fixing seat according to the first embodiment of the present disclosure.

As shown in FIG. 4 to FIG. 6, an upwardly concave bottom slide groove 33 is formed at the bottom surface of the sliding seat 30, and the guiding extension portion 22 can be accommodated into the bottom slide groove 33. Two inwardly protruding flanges 331 are respectively formed on the bottom edge of the opposite sides of the bottom slide groove 33. Two side grooves 332 are respectively formed between the two flanges 331 and the upper sidewalls of the bottom slide groove 33. When the sliding seat 30 is disposed on the guiding extension portion 22, two guiding flanges 223 are respectively engaged in the two side grooves 332. Therefore, the bottom of the sliding seat 30 is slidably sleeved on the guiding extension portion 22.

Figure 10:
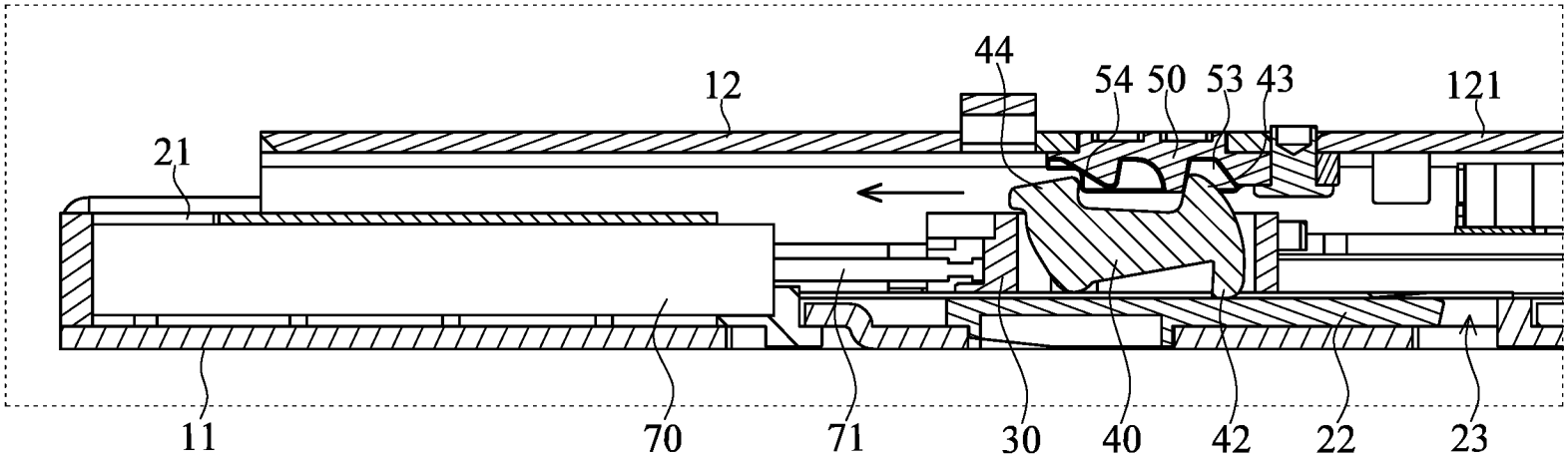

As shown in FIG. 2, FIG. 9, and FIG. 10, the two springs 60 are disposed on two sides of the fixing seat 20 and the sliding seat 30 along the horizontal axis direction D2 in parallel. In the present embodiment, a bottom surface of the fixing seat 20 has two first spring fixing portions 24 disposed on the two sides of the bottom surface of the fixing seat 20 along the horizontal axis direction D2. Two sides of the sliding seat 30 opposite to the two first spring fixing portions 24 along the horizontal axis direction D2 also has two second spring fixing portions 34. A front end of the two springs 60 are connected between the two first spring fixing portions 24 and the two second spring fixing portions 34. When the sliding seat 30 moves to a first position 221, the two springs 60 can be stretched and then accumulate elastic force. When the two springs 60 rebound, the sliding seat 30 can be displaced to a second position 222 by the elastic force of the two springs 60.

The buffer 70 includes a buffer cylinder 72 and a telescopic rod 71 disposed within the buffer cylinder 72. The buffer cylinder 72 can be inserted into a buffer receiving portion 212 disposed at the center of the fixing seat 20, and the telescopic rod 71 is can stretch along the longitudinal axis direction D1. A front end of the telescopic rod 71 is connected to a telescopic rod connecting portion 35 of the rear end of the sliding seat 30. When the sliding seat 30 moves toward the second position 222, the telescopic rod 71 can be driven to be shortened such that the buffer cylinder 72 generates a dampening force.

Figure 3:
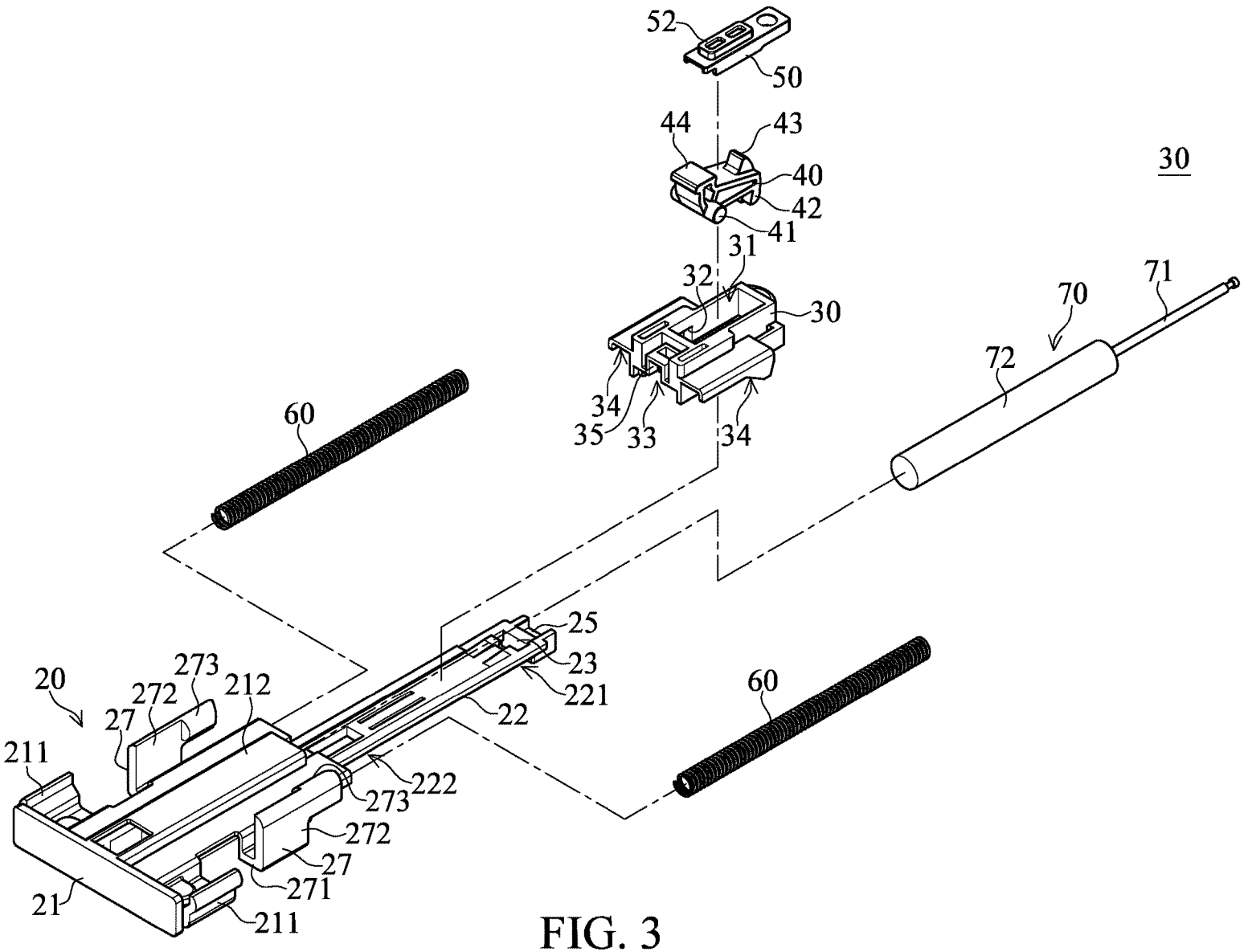
FIG. 3 is an exploded perspective view of the self-locking device with buffer mechanism according to the first embodiment of the present disclosure.

As shown in FIG. 2 and FIG. 3, the hook member 40 has the rotating shafts 41 disposed on two sides of the hook member 40 along the horizontal axis direction D2. The hook member 40 is pivotally connected to the receiving portion 31 of the sliding seat 30 through the two rotating shafts 41. The hook member 40 defines a side of the hook member 40 toward the guiding extension portion 22 as a bottom surface, and defines a side of the hook member 40 toward the inner rail 12 as a top surface. The bottom surface of the hook member 40 has a first hook 42, and the top surface of the hook member 40 has a second hook 43. A backside of the top surface of the hook member 40 has an abutting protrusion 44.

The connecting member 50 is disposed on the inner rail 12 such that the inner rail 12 can be interlinked with the hook member 40 and the sliding seat 30. The connecting member 50 is fixed in a rivet hole 124 of the bottom plate of the inner rail 121 by a rivet 51. A top end of connecting member 50 has a connecting protrusion 52. The connecting member 50 can be engaged to a connecting hole 125 formed on the bottom plate of the inner rail 121 such that the connecting member 50 is positioned on the bottom plate of the inner rail 121.

Figure 11:
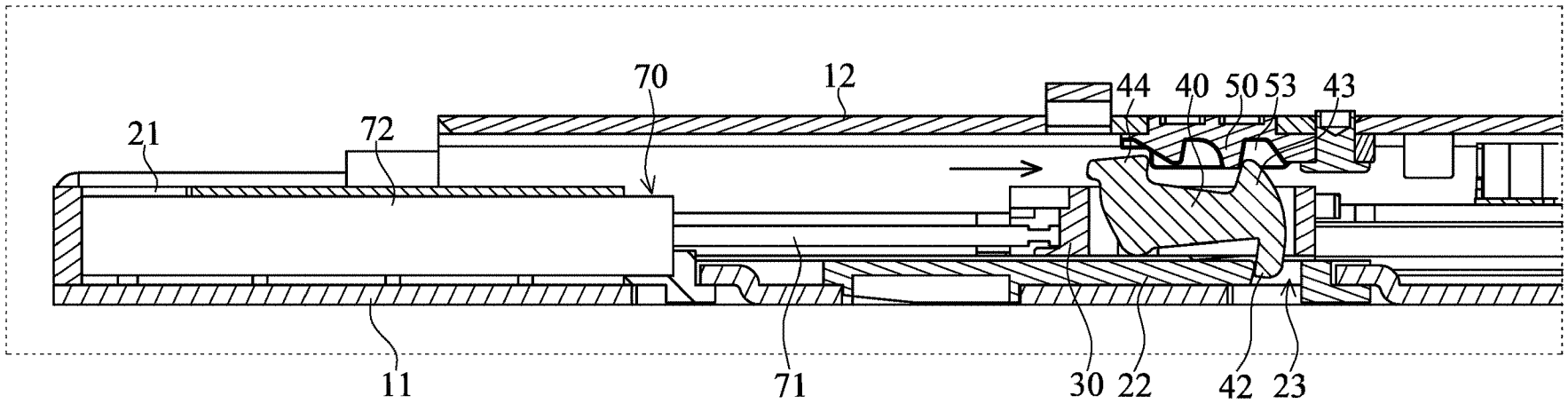
FIG. 11 is a schematic view showing the interlinking manner of the connecting member and the hook member when the slide rail is opened.

As shown in FIG. 9 to FIG. 11, the connecting member 50 has a connecting groove 53 formed on a side of the connecting member 50 facing toward the outer rail 11. A driving inclined plane 54 is formed on a backside of the connecting member 50. When the sliding seat 30 is positioned at the first position 221, the first hook 4 of the hook member 40 can be engaged in the positioning slot 23. When the connecting member 50 is displaced rearward with the inner rail 12, the driving inclined plane 54 is pushed up to the abutting protrusion 44 of the hook member 40. Therefore, the hook member 40 is driven to swing along the direction toward the inner rail 12 such that the first hook 42 is separated from the positioning slot 23 and the second hook 43 is engaged into the connecting groove 53 of the connecting member 50.

When the hook member 40 connected with the connecting member 50 is separated from the positioning slot 23, the sliding seat 30 can be moved toward the second position 222 by the two springs 60. The inner rail 12 is also moved to the closed position as the sliding seat 30 is displaced rearward. In the above manner, when the inner rail 12 is pushed near the closed position such that the connecting member 50 is connected with the hook member 40, the inner rail 12 can be automatically displaced to the closed position by the two springs 60.

As shown in FIG. 11, when the inner rail 12 moves from the closed position to the opened position, the connecting member 50 can drive the hook member 40 and the sliding seat 30 to be displaced from the second position 222 to the first position 221. When the sliding seat 30 is displaced to the first position 221 and the first hook 42 is aligned with the positioning slot 23, the hook member 40 can swing toward the guiding extension portion 22 such that the first hook 42 is engaged in the positioning slot 23, and the second hook 43 and the connecting groove 53 are disengaged.

As shown in FIG. 2, FIG. 3, FIG. 7, and FIG. 8, another feature of the present embodiment is that a fixing seat 20 has two side positioning members 27 respectively disposed on the two sides of the fixing seat 20 along the horizontal axis direction D2. When the inner rail 12 moves to the closed position, the rear end of the inner rail 12 can be engaged with the two side positioning members 27. In the present embodiment, the two side positioning members 27 are integrally formed on the two sides of the body portion 21 of the fixing seat 20 along the horizontal axis direction D2. Each of the side positioning members 27 includes a horizontal connecting portion 271 connected to two sides of the body portion 21 along the horizontal axis direction D2, a positioning plate 272 connected to an end of the horizontal connecting portions 271 opposite to the body portion 21, and a positioning protrusion 273 opposite to the position of the ball groove 123 of the inner rail 12. A spacing between inner sides of the two positioning plates 272 is slightly greater than a width of the inner rail 12 along the horizontal axis direction D2 such that the two sides of the inner rail 12 along the horizontal axis direction D2 can be accommodated between the two positioning plates 272. The two positioning protrusions 273 and the two ball grooves 123 complement each other in shape. Therefore, when the inner rail 12 is displaced to the closed position, the two positioning protrusions 273 can be connected with the rear ends of the two ball grooves 123 of the inner rail 12. Therefore, the rear end of the inner rail 12 and the two side positioning members 27 are connected, and the rear end of the inner rail 12 can be prevented from being shaken so as to prevent the connecting member 50 and the hook member 40 from being detached.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A self-locking slide rail device with buffer mechanism comprising:

a slide rail including an outer rail and an inner rail, wherein the outer rail defines a longitudinal axis direction and a horizontal axis direction, and two ends of the outer rail along the longitudinal axis direction are respectively defined as a front end and a rear end; wherein the slide rail has a bottom plate of the outer rail and sidewalls of the outer rail located on two sides of the bottom plate of the outer rail along the horizontal axis direction; wherein the inner rail is disposed on the outer rail, and the inner rail is capable of reciprocally moving along the longitudinal axis direction between an open position near the front end of the outer rail and a closed position near the rear end of the outer rail;

a fixing seat disposed on the rear end of the outer rail, wherein the fixing seat has a body portion and a guiding extension portion, wherein the guiding extension portion is connected to the front end of the body portion and extends towards a direction of the front end of the slide rail, and the fixing seat has a positioning slot formed at the position near the front end position of the guiding extension portion;

a sliding seat slidably disposed on the guiding extension portion and being capable of reciprocally moving between a first position adjacent to the front end of the guiding extension portion and a second position adjacent to the rear end of the guiding extension portion;

a hook member swingably disposed on the sliding seat, wherein when the sliding seat moves to the first position, the hook member is capable of being engaged in the positioning slot so as to fixedly position the sliding seat at the first position;

two springs disposed in parallel with each other on the fixing seat and two sides of the sliding seat along the horizontal axis direction, wherein two ends of each of the two springs are respectively connected to the fixing seat and the sliding seat;

a connecting member disposed on a side of a bottom plate of the inner rail facing towards the outer rail, wherein when the inner rail moves to the closed position, the connecting member is capable of driving the hook member to swing and disengage from the positioning slot, such that the hook member is coupled to the connecting member; wherein the inner rail and the sliding seat are capable of interlinking with each other by the hook member and the connecting member so as to be capable of synchronous movement; and a buffer disposed on the center of the body portion, and the buffer including a buffer cylinder and a telescopic rod telescopically disposed within the buffer cylinder, wherein a front end of the telescopic rod is connected to the rear end of the sliding seat and is capable of stretching along the longitudinal axis direction, wherein the sliding seat is capable of shortening the telescopic rod when the sliding seat moves toward the second position;

wherein the fixing seat has a first positioning engagement portion that is disposed on the guiding extension portion and protruding toward the front end direction of the slide rail, and the fixing seat further has a second positioning engagement portion disposed between the first positioning engagement portion and the body portion, wherein the slide rail further includes a first positioning hook and a second positioning hook respectively disposed on the positions where the bottom plate of the outer rail corresponds to the first positioning engagement portion and the second positioning engagement portion, and wherein the first positioning hook engages with the first positioning engagement portion, and the second positioning hook engages with the second positioning engagement portion;

wherein two side positioning members are respectively disposed on two sides of the body portion of the fixing seat along the horizontal axis direction, wherein when the inner rail moves to the closed position, the rear end of the inner rail is accommodated between the two side positioning members, wherein the two side positioning members each have a horizontal connecting portion, a positioning plate and a positioning protrusion, wherein the two horizontal connecting portions are connected to two sides of the body portion along the horizontal axis direction, wherein the two positioning plates ae connected to an end of the respective horizontal connecting portions opposite to the body portion, wherein a spacing between the two positioning plates is greater than a width of the inner rail along the horizontal axis direction so as to accommodate the rear end of the inner rail, and wherein the two positioning protrusions are formed at inner side surfaces of the two positioning plates, and the two positioning protrusions and two grooves of the inner rail correspond to each other in position and complement each other in shape so as to be connected to each other;

wherein two sides of the body portion of the fixing seat along the horizontal axis direction each has a top support portion spaced at a distance from the respective side positioning members in the longitudinal axis direction, and the two-top support portions are capable of respectively abutting against the inner side surfaces of the two sidewalls of the outer rail, and wherein the fixing seat is fixed on the rear end of the outer rail by interference between the two top support portions and the two sidewalls of the outer rail.

2. The self-locking slide rail device according to the claim 1, wherein the sliding seat has a receiving portion, and a pivot slot is formed at the two sidewalls of the receiving portion along the horizontal axis direction, wherein the hook member is capable of being received in the receiving portion, and the hook member has a rotating shaft at the two sides along the horizontal axis direction, and wherein the two rotating shafts are respectively capable of being engaged in the two pivot slots.

3. The self-locking slide rail device according to the claim 2, wherein a first hook is formed at a side of the hook member facing toward the guiding extension portion, and a second hook and an abutting protrusion are formed at a side of the hook member opposite to the guiding extension portion, wherein when the sliding seat moves to the first position, the first hook is capable of being aligned with the positioning slot and being engaged in the positioning slot; wherein a driving inclined plane and a connecting groove are formed on a side of the connecting member facing toward the outer rail, wherein the driving inclined plane of the connecting member is capable of pushing the abutting protrusion to drive the hook member to swing and disengage from the positioning slot, such that the second hook is engaged in the connecting groove such that the connecting member and the hook member together are coupled to each other.

4. The self-locking slide rail device according to the claim 3, wherein a bottom slide groove is formed at the bottom surface of the sliding seat, and the guiding extension portion is received in the bottom slide groove such that the sliding seat is slidably disposed at the guiding extension portion.

5. The self-locking slide rail device according to the claim 4, wherein a guiding flange is formed at two sides of the guiding extension portion along the horizontal axis direction, and a side groove is formed on two sidewalls of the bottom slide groove along the horizontal axis direction, and wherein when the sliding seat is disposed on the guiding extension portion, the two guiding flanges are respectively engaged in the two side grooves.

* * * * *